United States Patent [19]

Degawa et al.

[11] 4,321,019

[45] Mar. 23, 1982

[54] SWASH PLATE TYPE COMPRESSOR

[75] Inventors: Takashi Degawa; Atsushi Suginuma, both of Mito; Hideo Usui, Katsuta; Kenichi Kawashima, Hitachi; Tsuneo Kan; Kunihiko Takao, both of Shimoinayoshi, all of Japan

[73] Assignee: Hitachi, Ltd., Tokyo, Japan

[21] Appl. No.: 44,216

[22] Filed: May 31, 1979

[30] Foreign Application Priority Data

Jun. 2, 1978 [JP] Japan ..... 53/65746
Jun. 14, 1978 [JP] Japan ..... 53/70882

[51] Int. Cl.[3] ..... F04B 1/16
[52] U.S. Cl. ..... 417/269
[58] Field of Search ..... 417/269, 270

[56] References Cited

U.S. PATENT DOCUMENTS

| | | | |
|---|---|---|---|
| 3,750,848 | 8/1973 | Nakayama | 184/6.16 |
| 3,801,227 | 4/1974 | Nakayama | 417/269 |
| 3,888,604 | 6/1975 | Oshima | 417/269 |
| 3,904,320 | 9/1975 | Kishi et al. | 417/269 |
| 3,930,758 | 1/1976 | Park | 417/269 |
| 3,955,899 | 5/1976 | Nakayama | 417/269 |
| 4,003,680 | 1/1977 | Nakayama | 417/439 |
| 4,127,363 | 11/1978 | Kato | 417/269 |
| 4,135,862 | 1/1979 | Degawa | 417/269 |

FOREIGN PATENT DOCUMENTS

| | | | |
|---|---|---|---|
| 21511128 | 5/1972 | Fed. Rep. of Germany | 417/269 |
| 52-36312 | 3/1977 | Japan | 417/269 |
| 52-72909 | 6/1977 | Japan | 417/269 |
| 54-154806 | 12/1979 | Japan | 417/269 |

*Primary Examiner*—William L. Freeh
*Attorney, Agent, or Firm*—Craig & Antonelli

[57] ABSTRACT

In a swash plate type compressor, an oil separating chamber is arranged in the course of the flow of coolant gas from an inlet to a low pressure chamber. An oil accumulating chamber is formed between the rear end of the drive shaft and the rear side cover. The oil accumulating chamber is communicated with the oil separating chamber and with a thrust bearing through an oil passage formed in the drive shaft. The thrust bearing is lubricated by use of oil from the oil accumulating chamber.

8 Claims, 2 Drawing Figures

SWASH PLATE TYPE COMPRESSOR

BACKGROUND OF THE INVENTION

This invention relates to a swash plate type compressor. More particularly, it relates to a swash plate type compressor suitable for use in an air conditioner for an automobile, etc. in the form in which oil separated from a coolant gas is directly introduced into a slide part.

In general, the lubricating system of the swash plate type compressor is classified into two sorts; one having a forced lubricating device, and the other separating oil contained in a coolant gas circulating in a cooling cycle and then directly supplying it to sliding surfaces in the compressor. The former has an oil accumulating chamber below a cylinder block, and sucks up oil accumulated in the chamber by means of an oil pump or the like and then feeds it to respective slide parts. Therefore, the lubrication is reliable, but the apparatus becomes costly. The latter has the feature that the construction is very simple. On the other hand, however, when the compressor is held stopped for long, oil on the sliding surfaces of radial bearings, thrust bearings and a swash plate drops. This results in the disadvantage that the various parts are not satisfactorily lubricated at the restarting of the compressor and that the durability of the compressor is drastically spoiled.

According to Japanese Pat. No. 25733 published in 1974, a residual oil accumulating chamber is formed between the rear end face of a drive shaft and a valve plate. The residual oil accumulating chamber is connected with a main oil accumulating chamber which is formed in the bottom of a compressor. On the other hand, the residual oil accumulating chamber is connected with a thrust bearing by an oil passage penetrating through the shaft. Oil in the residual oil accumulating chamber is supplied to the thrust bearing owing to a centrifugal force which develops in the oil with the rotation of the shaft. Simultaneously therewith, oil in the main oil accumulating chamber is sucked up into the residual oil accumulating chamber. With the construction disclosed in this prior art, the force for sucking up into the residual oil accumulating chamber the oil which exists in the main oil accumulating chamber located below the residual oil accumulating chamber is the centrifugal force bestowed on the oil with the rotation of the shaft. Therefore, in case where the rotational frequency of the shaft is low, it is feared that the oil will not be sufficiently sucked up. It is also feared that the oil in the residual oil accumulating chamber will drop into the main oil accumulating chamber during the stop of the compressor and that the lubrication of the thrust bearing and the swash plate will not be satisfactorily executed at the restarting.

SUMMARY OF THE INVENTION

An object of this invention is to provide a swash plate type compressor of high reliability which is surely capable of lubrication to the sliding surfaces of a radial bearing, a thrust bearing and a swash plate without adopting the forced lubrication system.

This invention is characterized in that an oil separating chamber formed above a drive shaft is communicated with a residual oil accumulating chamber which is disposed at the rear end of the shaft in a boss portion of a cylinder block, and that after accumulating oil in the residual oil accumulating chamber temporarily, the oil is supplied to a thrust bearing through a penetrating hole in the shaft by a centrifugal force which is bestowed on the oil with the rotation of the shaft.

DETAILED DESCRIPTION OF THE PREFERRED EMBODIMENT

Figure 1:
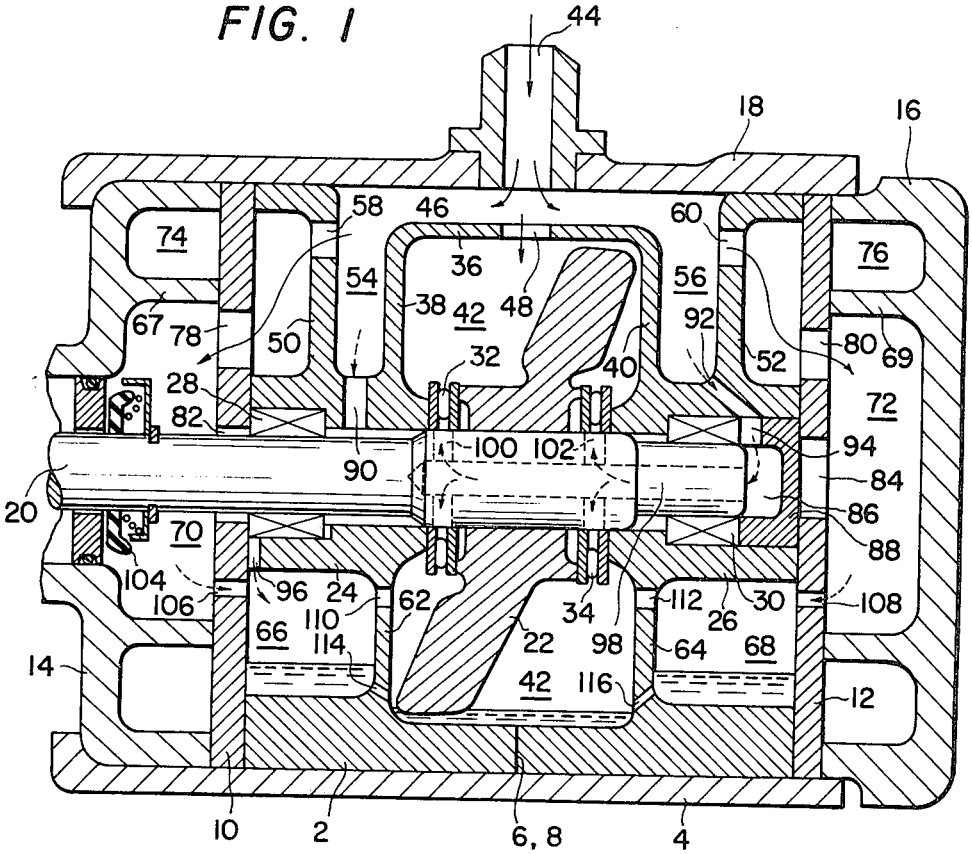
FIG. 1 is a sectional view of a swash plate type compressor showing an embodiment of this invention.

An embodiment of this invention will be described with reference to FIG. 1.

Two cylinder blocks 2 and 4 are joined at respective end faces 6 and 8. The cylinder blocks 2 and 4, and side covers 14 and 16 respectively mounted on outer end faces of these cylinder blocks through valve plates 10 and 12 are fixed to a cylindrical compressor housing 18. A drive shaft 20 is supported in the central parts of the cylinder blocks 2 and 4. A swash plate 22 is fitted on the shaft 20. The swash plate 22 is provided with a slipper, a ball and a piston (none of which is shown). These members are assembled in the cylinder blocks 2 and 4. Boss portions 24 and 26 are formed in the vicinities of the central parts of the cylinder blocks 2 and 4, respectively. Radial bearings 28 and 30 are respectively held in the boss portions 24 and 26, to rotatably journal the shaft 20 therein. Further, thrust bearings 32 and 34 are respectively held on the swash plate sides of the boss portions 24 and 26, to bear the axial components of force of the swash plate 22.

In the vicinity of the swash plate 22 inside the cylinder blocks 2 and 4, an outer-peripheral partition wall 36 is disposed at the outer periphery of the swash plate 22, and side partition walls 38 and 40 are disposed on both sides of the swash plate 22. These partition walls 36, 38 and 40 define a swash plate chamber 42. Further, a low pressure passage 46 is defined between the outer peripheral surface of the outer-peripheral partition wall 36 and the inner peripheral surface of the compressor housing 18 near a coolant gas suction port 44. An opening 48 is provided in that position of the outer-peripheral partition wall 36 which opposes to the coolant gas suction port 44. On both the outer sides of the side partition walls 38 and 40, oil separating chambers 54 and 56 are respectively defined between these side partition walls and oil separating walls 50 and 52. Apertures 58 and 60 through which a coolant gas passes are respectively provided in the oil separating walls 50 and 52 near the compressor housing 18. On both sides of the swash plate chamber 42 and below the shaft 20, main oil accumulating chambers 66 and 68 are respectively formed through partition walls 62 and 64.

The side covers 14 and 16 are respectively provided with low pressure chambers 70 and 72 and high pressure chambers 74 and 76 which are partitioned by annular partition walls 67 and 69. The low pressure chambers 70 and 72 are located on the central sides, and they are circular. The high pressure chambers 74 and 76 are concentric with the low pressure chambers 70 and 72, and they are annular.

The valve plates 10 and 12 interposed between the side covers 14 and 16 and the cylinder blocks 2 and 4 are respectively provided with apertures 78 and 80 for introducing the coolant gas into the low pressure chambers 70 and 72, in the corresponding positions of the valve plates 10 and 12. Further, the two valve plates 10 and 12 are respectively formed with openings 82 and 84 which are located in the central parts thereof and which serve to insert the shaft 20.

A chamber 86 is formed between the rear end of the shaft 20 and the valve plate 12, and it is greater than a clearance which is set in an ordinary rotary part. A spacer 88 is inserted in the chamber 86. The spacer 88 is a cylindrical member provided with a bottom plate at one end thereof. This spacer 88 functions to keep the radial bearing 30 and also to close up the opening 84 of the valve plate 12. Owing to this spacer 88, the residual oil accumulating chamber 86 which is open on the side abutting on the shaft 20 is formed. By making the spacer 88 the cylindrical member as specified above, the low pressure chamber 72 and the residual oil accumulating chamber 86 can be shut off even when the valve plate 12 on the rear side is formed with the opening 84. As a result, both the valve plates 10 and 12 can be put into the identical shape. This is suitable for mass production.

Slots 90 and 92 are respectively provided in the bottom parts of the oil separating chambers 54 and 56. One slot 90 communicates with the radial bearing 28 through the clearance between the outer periphery of the shaft 20 and the boss portion 24, while the other slot 92 connects with the residual oil accumulating chamber 86. The spacer 88 is provided with an aperture 94 in correspondence with the slot 92. The boss portion 24 is provided with an aperture 96, through which oil is introduced into the main oil accumulating chamber 66.

At the central part of the shaft 20, a hole 98 is formed one end of which is open to the residual oil accumulating chamber 86 and the other end of which connects with apertures 100 and 102 respectively being open to the thrust bearings 32 and 34. On the turning-effort transmitting side of the shaft 20, that is, on the front side of the compressor, shaft sealing means 104 is mounted between the side and the side cover 14. The valve plates 10 and 12 are respectively provided with apertures 106 and 108 which bring the main oil accumulating chambers 66 and 68 and the low pressure chambers 70 and 72 into communication. Oil separated from the coolant gas within the low pressure chamber 70 and 72 flows into the main oil accumulating chambers 66 and 68 through the apertures 106 and 108, respectively. The side partition walls 62 and 64 between the swash plate chamber 42 and the main oil accumulating chambers 66 and 68 are respectively provided with apertures 110 and 112 on the sides close to the shaft 20, and with apertures 114 and 116 on the sides close to the compressor housing 18.

Now, the lubricating operation of the oil separated within the compressor will be described. Inside the cylinder blocks 2 and 4, a piston (not shown) which reciprocates in the axial direction of the shaft 20 is connected to the swash plate 22 through a ball and a slipper (not shown), and a pumping action is effected by the rocking of the swash plate 22. The coolant gas having flowed in from the coolant gas suction port 44 branches off into a portion which advances rectilinearly without turning and flows into the swash plate chamber 42 through the opening 48, and a portion which flows into the front and rear oil separating chambers 54 and 56 through the low pressure passage 46. Part of the oil in the coolant gas which has moved rectilinearly and flowed into the swash plate chamber 42 and which has a greater specific gravity is separated from the coolant gas and drops to the rotating swash plate 22, to lubricate sliding parts. In particular, as soon as the coolant gas has flowed into the swash plate chamber 42 at the starting of the compressor, the swash plate 22 and the thrust bearings 32 and 34 can be lubricated. On the other hand, the oil in the coolant gas which has been led from the narrow low-pressure passage 46 into the broad oil-separating chambers 54 and 56 stalls here or collides against the oil separating walls 50 and 52, to be accumulated in the lower parts. The oil separated from the coolant gas in the oil separating chamber 54 on the front side passes through the slot 90 provided in the boss portion 24 and lubricates the radial bearing 28, whereupon it flows down into the main oil accumulating chamber 66 through the aperture 96. On the other hand, the oil separated from the coolant gas in the oil separating chamber 56 on the rear side flows into the residual oil accumulating chamber 86 through the slot 92 provided in the boss portion 26 and the aperture 94 provided in the spacer 88, and it is once accumulated here.

The oil accumulated in the residual oil accumulating chamber 86 is fed to the thrust bearings 32 and 34 and lubricate them owing to the centrifugal pumping action during the rotation of the swash plate 22. The oil on the surface of the swash plate 22 is accumulated in the lower part of the swash plate chamber 42 when the rotation of the swash plate 22 is stopped. The oil accumulated in the oil separating chambers 54 and 56 and the residual oil accumulating chamber 86 flows down into the main oil accumulating chambers 66 and 68.

During the rotation of the swash plate 22, it is usual that the interior of the swash plate chamber 42 is under a comparatively high pressure on account of a high-pressure blow-by gas having leaked from a cylinder (not shown), whereas the low pressure chamber is under a comparatively low pressure on account of the suction of the cylinder. For this reason, the oil accumulated in the main oil accumulating chambers 66 and 68 cannot flow into the swash plate chamber 42 through the apertures 114 and 116 during the rotation of the swash plate 22. The oil having lubricated the thrust bearings 32 and 34 flows down to the lower part of the swash plate chamber 42. This oil, however, is stirred by the swash plate 22 and vaporizes due to heat taken from the high-temperature blow-by gas as well as the sliding parts, so that it spouts into the main oil accumulating chambers 66 and 68 from the apertures 110 and 112. This gaseous oil and oil evaporated in the main oil accumulating chambers 66 and 68 are sucked into the low pressure chambers 70 and 72 through the apertures 106 and 108 of the valve plates 10 and 12, and are further sucked into the cylinder together with the coolant gas, to lubricate the sliding parts of the cylinder and the piston. Further, the greater part of the oil is discharged into the cooling cycle together with the compressed coolant gas, and the remaining oil is returned into the swash plate chamber 42 again together with the blow-by gas.

The shaft sealing means 104 disposed in the low pressure chamber 70 of the side cover 14 is cooled by the sucked coolant gas and is lubricated by the oil contained in the coolant gas within the low pressure chamber 70. It is accordingly prevented from seizing up.

Upon stopping of the compressor, the oil which adheres to the walls and other parts in the compressor flows down to the bottom parts of the main oil accumulating chambers 66 and 68 and the swash type chamber 42. Upon stopping of the rotation of the swash plate 22, the internal pressures of the swash plate chamber 42, the low pressure chambers 70 and 72 and the main oil accumulating chambers 66 and 68 get balanced gradually. Then, the oil inside the main oil accumulating chambers 66 and 68 flows into the swash plate chamber 42 through the apertures 114 and 116 to increase the quantity of oil within the swash plate chamber 42, so that the lower part of the swash plate 22 is reliably immersed in the oil. In this way, the surface of the swash plate 22 gets wet with the oil by one revolution of the swash plate 22 at the starting even when the compressor has been let stand for a long time and the swash plate 22 is therefore dry. Accordingly, the seizure of the swash plate 22 is prevented.

In the present embodiment, the residual oil accumulating chamber 86 is disposed in the cylinder block 4. This structure can make the shape of the side cover simpler than in a structure in which the chamber 86 is disposed in the low pressure chamber 72 of the side cover 16. It is also possible to set the effective volume of the low pressure chamber 72 at a larger value. There is also an example in which the residual oil accumulating chamber 86 is disposed in the valve plate 12. In this case, however, the working of the valve plate 12 becomes complicated.

Figure 2:
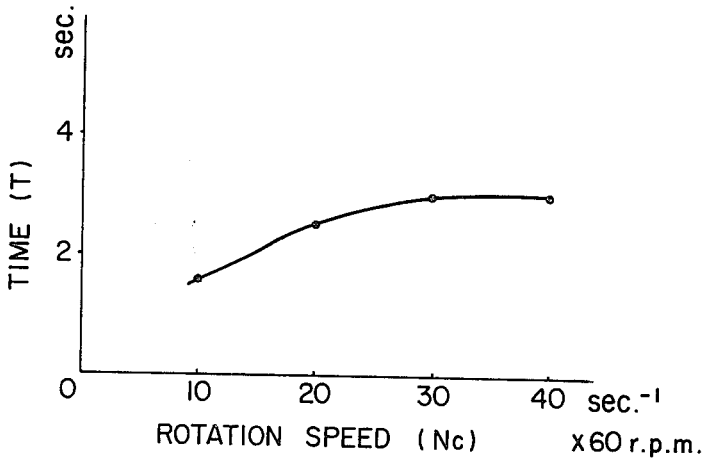
FIG. 2 is a graph showing the relationship between the rotation speed of a compressor and the return time of oil.

According to this invention, the oil is introduced from the oil separating chamber 56 formed above the shaft 20, into the residual oil accumulating chamber 86 formed between the rear end face of the shaft 20 and the valve plate 12. Therefore, the oil can be accumulated in the residual oil accumulating chamber 86 throughout the operation of the compressor, and it can be fed to the thrust bearings 32 and 34 with a small centrifugal force. The oil can also be sufficiently fed to the radial bearing 30. Even when, in restarting the compressor after having stopped it, the oil in the residual oil accumulating chamber 86 is in a small amount, the oil is introduced into the residual oil accumulating chamber 86 promptly after the starting, and it is supplied to the thrust bearings 32 and 34 in a short time with a low rotational frequency at the starting. FIG. 2 shows the relationship betwen the rotation speed ($N_c$) at the starting of the compressor and the return time (T) of the oil from an evaporator into the compressor in the cooling cycle. The quantity of the coolant gas in the measurement of the relationship was 1.2 kg. According to FIG. 2, the coolant gas returns to the compressor in 2 to 3 seconds after the starting and simultaneously flows into the swash plate chamber 42 so as to lubricate the swash plate 22 and the thrust bearings 32 and 34 by the oil contained in the coolant gas. Thus, the thrust bearings 32 and 34 are lubricated immediately after compressor start-up by means of the passages 92, 98, 100, 102, and residual chamber 86, and compressor durability is not adversely affected since, as noted above, only a few rotations will have occurred in the 2 to 3 seconds required to circulate the coolant and lubricate the bearings.

What is claimed is:

1. A swash plate type compressor comprising a cylindrical compressor housing having an inlet for coolant gas, a cylinder block assembly supported within said compressor housing, a drive shaft rotatably supported by radial bearings at its ends in said cylinder block assembly and having an oil passage therein opening at one end to the rear end thereof and at the other end to thrust bearings, front and rear side covers disposed at opposite ends of said cylinder block assembly, said side covers disposed at opposite ends of said cylinder block assembly, said side covers having a low pressure chamber at a radially central portion and a high pressure chamber spaced radially outwardly from the low pressure chamber, seal means disposed at the front end of said drive shaft, front and rear valve plates interposed between said cylinder block assembly and respective ones of said side covers, and a swash plate fitted between said thrust bearings on said drive shaft so as to rotate with said shaft, said cylinder block assembly forming therein a swash plate chamber enclosing said swash plate; at least one main oil accumulating chamber positioned at the bottom of said cylinder block assembly, a chamber for separating oil from coolant gas and disposed in the course of the flow of the coolant gas from the inlet to the low pressure chamber, and a residual oil accumulating chamber positioned between the rear end of said shaft and said rear valve plate and communicating with the oil separating chamber and the oil passage in said drive shaft to form a means for supplying sufficient oil to said thrust bearings for lubricating same immediately after said compressor is started, wherein the residual oil accumulating chamber comprises a hollow cylindrical member that is closed on an end facing said rear valve plate and is open at an end communicating with said drive shaft passage.

2. A swash plate type compressor lubricated by oil which is separated from coolant gas in a cooling cycle, characterized in that said swash plate type compressor includes a chamber for separating oil from coolant gas and disposed in the course of the flow of the coolant gas from an inlet to a low pressure chamber, at least one main oil accumulating chamber positioned at the bottom of cylinder block assembly of said compressor, and means for supplying sufficient oil to thrust bearings supporting the driveshaft for lubricating same immediately after said compressor is started comprising a residual oil accumulating chamber positioned between the rear end of the drive shaft and a rear valve plate, an oil passage communicating said oil separating chamber with said residual oil accumulating chamber, and another oil passage in said drive shaft for communicating said residual oil accumulating chamber with said thrust bearings supporting said drive shaft, wherein the residual oil accumulating chamber comprises a hollow cylindrical member that is closed on an end facing said rear valve plate and is open at an end communicating with said drive shaft passage.

3. A swash plate type compressor of claim 1, wherein the swash plate chamber provides an inlet of the coolant gas therethrough.

4. A swash plate type compressor of claim 1 or 2, wherein the oil separating chamber is positioned above said drive shaft.

5. A swash plate type compressor of claim 1 or 2, the radial bearing is communicated with the oil separating chamber and with the main oil accumulating chamber.

6. A swash plate type compressor according to claim 1 or 2, wherein the front and rear valve plates are of identical construction and said cylindrical member closes an opening in the rear valve plate.

7. A swash plate type compressor according to claim 1 or 2, wherein a radial bearing supporting the rear end of the drive shaft is retained on said drive shaft by said cylindrical member abutting same and said rear valve plate.

8. A swash plate type compressor according to claim 7, wherein the front and rear valve plates are of identical construction and said cylindrical member closes an opening in the rear valve plate.

* * * * *